US010290252B2

(12) United States Patent
Chen et al.

(10) Patent No.: US 10,290,252 B2
(45) Date of Patent: May 14, 2019

(54) IMAGE DISPLAY METHOD, IMAGE DISPLAY APPARATUS AND DELTA PIXEL ARRANGEMENT DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Chung Chun Chen, Beijing (CN); Mubing Li, Beijing (CN); Peng Liu, Beijing (CN); Pengcheng Lu, Beijing (CN); Xue Dong, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 178 days.

(21) Appl. No.: 15/175,409

(22) Filed: Jun. 7, 2016

(65) Prior Publication Data

US 2016/0365023 A1 Dec. 15, 2016

(30) Foreign Application Priority Data

Jun. 10, 2015 (CN) ..... 2015 1 0317250

(51) Int. Cl.
*G09G 3/36* (2006.01)
*G09G 3/20* (2006.01)

(52) U.S. Cl.
CPC ..... *G09G 3/2007* (2013.01); *G09G 3/3607* (2013.01); *G09G 3/3611* (2013.01);
(Continued)

(58) Field of Classification Search
CPC ... G09G 3/3607; G09G 3/3611; G09G 3/2007
See application file for complete search history.

(56) References Cited

U.S. PATENT DOCUMENTS 6,198,467 B1 3/2001 Chiang
2004/0061711 A1* 4/2004 Kurumisawa ..... G09G 3/3607 345/698

(Continued)

FOREIGN PATENT DOCUMENTS

CN 1811896 A 8/2006
CN 103151018 A 6/2013
CN 103903549 A 7/2014

OTHER PUBLICATIONS

Chinese Office Action dated Aug. 11, 2017.
Chinese Office Action dated Dec. 21, 2016.

*Primary Examiner* — Roy P Rabindranath
(74) *Attorney, Agent, or Firm* — Dilworth & Barrese, LLP; Michael J. Musella, Esq.

(57) ABSTRACT

An image display method is disclosed. The image display method is adapted to a delta pixel arrangement display device, and the delta pixel arrangement display device includes M×N second pixels arranged in form of an M×N matrix. The display method includes: acquiring raw data of a frame of image, the raw data including luminance information of a*M×b*N first pixels arranged in form of an a*M×b*N matrix, where a≥1, b≥1 and a×b≠1, the first pixels arranged in strip and the first pixel at least including sub-pixels with three different colors RGB; converting the raw data into display data, the display data including luminance information of M×N second pixels, and each of the second pixels at least comprising respective sub-pixels of corresponding one of the first pixels; and displaying an image
(Continued)

according to the display data. An image display apparatus and a delta pixel arrangement display device are further disclosed.

16 Claims, 9 Drawing Sheets

(52) U.S. Cl.
CPC ..... *G09G 3/3648* (2013.01); *G09G 2300/08* (2013.01); *G09G 2320/0626* (2013.01); *G09G 2320/0666* (2013.01); *G09G 2340/0457* (2013.01)

(56) References Cited

U.S. PATENT DOCUMENTS

| | | | | |
|---|---|---|---|---|
| 2004/0174389 | A1* | 9/2004 | Ben-David | G09G 3/3413 345/694 |
| 2010/0225680 | A1 | 9/2010 | Kido | |
| 2013/0147805 | A1* | 6/2013 | Chang | H04N 7/0117 345/428 |

* cited by examiner

IMAGE DISPLAY METHOD, IMAGE DISPLAY APPARATUS AND DELTA PIXEL ARRANGEMENT DISPLAY DEVICE

TECHNICAL FIELD

At least one embodiment of the present disclosure relates to an image display method, an image display apparatus and a delta pixel arrangement display device.

BACKGROUND

In LCD (Liquid Crystal Display) industry, LCD display device generally comprises a strip pixel arrangement display device and a delta pixel arrangement display device.

FIG. 1 shows a schematic diagram of a pixel arrangement of a conventional strip pixel arrangement display device 100. In the strip pixel arrangement display device 100, each pixel 10 comprises a red (R) sub-pixel, a green (G) sub-pixel and a blue (B) sub-pixel. Each sub-pixel of the pixel 10 presents different luminance respectively, and the pixel 10 display different colors by mixing the different luminance. When a resolution of the strip pixel arrangement display device is 720×480, it means that the strip pixel arrangement display device has 480 horizontal lines of pixels, each line having 720 pixels.

FIG. 2 shows a schematic diagram of a pixel arrangement of a conventional delta pixel arrangement display device 200, and in this device 200, pixels arranged in an odd horizontal line is shifted a half pixel from a corresponding pixel arranged in an even horizontal line. In case of having a same size as the strip pixel arrangement display device 100 illustrated in FIG. 1, when a resolution of the delta pixel arrangement display device is 360×480, the delta pixel arrangement display device 200 has 480 horizontal lines of pixels, each line having 480 pixels.

Because area of each pixel in the delta pixel arrangement display device 200 is greater than area of each pixel in the strip pixel arrangement display device 100, the delta pixel arrangement display device is easier to be manufactured. However, resolution of the delta pixel arrangement display device 200 is less than resolution of the strip pixel arrangement display device 100, so display precision of the delta pixel arrangement display device is not high and display effect is not satisfactory.

SUMMARY

At least one embodiments of the disclosure provides an image display method, adapted to a delta pixel arrangement display device, the delta pixel arrangement display device comprises M×N second pixels arranged in an M×N matrix, the display method comprising:

acquiring raw data of a frame of image, the raw data comprising luminance information of a*M×b*N first pixels arranged in a*M×b*N matrix, where a≥1, b≥1 and a×b≠1, the first pixels are arranged in strip and each of the first pixels at least comprises sub-pixels with three different colors RGB;

converting the raw data of the image into display data, the display data comprising luminance information of M×N second pixels, and each of the second pixels at least comprising respective sub-pixels in corresponding one of the first pixels; and displaying the image according to the display data.

In an embodiment of the disclosure, both of a and b are positive integers, the raw data comprise luminance information of M×N first pixel group arranged in an M×N matrix, in which each row comprises M first pixel group, each column comprises N first pixel group, each of the first pixel groups comprises a×b first pixels, and luminance information of each firs pixel group comprises luminance information of a×b first pixels thereof, converting the raw data of the image into the display data comprise: converting the luminance information of M×N first pixel groups of the raw data into the luminance information of M×N second pixels.

In an embodiment of the disclosure, the luminance information of the first pixels comprises luminance information of each of the sub-pixels of the first pixel, and the luminance information of the second pixel comprises luminance information of each of the sub-pixels of the second pixel;

converting luminance information of M×N first pixel groups of the raw data into luminance information of M×N second pixels comprises determining each of the second pixels of the M×N second pixels and its corresponding first pixel group of M×N first pixel groups; and calculating average luminance of sub-pixels, having a same color, of a×b first pixels of each of the first pixel groups to obtain the luminance information of each of the second pixels.

In an embodiment of the disclosure a and b are positive fractions, or a or b is a positive fraction;

converting the raw data of the image into the display data comprise:

converting the raw data into adjustment data, the adjustment data comprise luminance information of k*M×p*N three pixels arranged in a k*M×p*N matrix, where k is an integer equal to or greater than a, p is an integer equal to or greater than b, and k×p>a×b; and converting the adjustment data into the display data.

In an embodiment of the disclosure, the adjustment data comprise luminance information of M×N second pixel groups arranged in an M×N matrix, in which each row comprises M second pixel groups, each column comprises N second pixel groups, each of the second pixel groups comprises k×p third pixels, and the luminance information of each of the second pixel groups comprises luminance information of the k×p third pixels thereof;

converting the adjustment data into the display data comprise:

converting the luminance information of M×N second pixel groups of the adjustment data into the luminance information of M×N second pixels.

In an embodiment of the disclosure, the luminance information of each first pixel comprises luminance information of the sub-pixels of this first pixel, the luminance information of each second pixel comprises luminance information of the sub-pixels of this second pixel, and the luminance information of each third pixel comprises luminance information of the sub-pixels of this third pixel;

converting the luminance information of M×N second pixel groups of the adjustment data into the luminance information of M×N second pixels comprises:

determining each of the second pixels of the M×N second pixels and its corresponding second pixel group of M×N second pixel groups; and calculating average luminance of sub-pixels, having a same color, of a×b third pixels of each of the second pixel groups to obtain the luminance information of each of the second pixels.

In an embodiment of the disclosure, the delta pixel arrangement display device is a liquid crystal display device, and the luminance information is transmittance information.

In an embodiment of the disclosure, acquiring the raw data of the fame of the image comprises:

acquiring grayscale information of a*M×b*N first pixels arranged in a*M×b*N matrix;

converting the grayscale information of the first pixels into transmittance information of the first pixels;

displaying the image according to the display data comprise:

conversing transmittance information of M×N second pixels into grayscale information of the second pixels; and displaying the image according to the grayscale information of the second pixels.

At least one embodiment of the disclosure provides an image display apparatus adapted to a delta pixel arrangement display device, the delta pixel arrangement display device comprises M×N second pixels arranged in an M×N matrix, the image display apparatus comprises:

an acquisition unit, configured to acquire raw data of a frame of image, the raw data comprise luminance information of a*M×b*N first pixels arranged in a*M×b*N matrix, where a≥1, b≥1 and a×b≠1, the first pixels are arranged in strip and each of the first pixels at least comprises sub-pixels with three different colors RGB;

a conversion unit, configured to convert the raw data into display data, the display data comprise luminance information of M×N second pixels, and the second pixel at least comprises respective sub-pixels of the first pixel; and a display unit, configured to display the image according to the display data.

In an embodiment of the disclosure, a and b are positive integers, respectively;

the raw data comprise luminance information of M×N first pixel group arranged in a M×N matrix, in which each row comprises M first pixel group, each column comprises N first pixel group, each of the first pixel groups comprises a×b first pixels, and the luminance information of each of the firs pixel groups comprises the luminance information of a×b first pixels thereof, and the conversion unit is configured to convert luminance information of M×N first pixel groups of the raw data into luminance information of M×N second pixels.

In an embodiment of the disclosure, the luminance information of each first pixel comprises luminance information of the sub-pixels of this first pixel, and the luminance information of each second pixel comprises luminance information of the sub-pixels of this second pixel;

the conversion unit comprises:

a first determination module, configured to determine each of the second pixels of the M×N second pixels corresponding to respective first pixel group among M×N first pixel groups; and a second determination module, configured to calculate average luminance of sub-pixels having a same color among a×b first pixels of each of the first pixel groups to obtain the luminance information of each of the second pixels.

In an embodiment of the disclosure, a or b is a positive fraction; the conversion unit comprises:

a first conversion module, configured to convert the raw data into adjustment data, the adjustment data comprise luminance information of k*M×p*N three pixels arranged in a k*M×p*N matrix, where k is an integer equal to or greater than a, p is an integer equal to or greater than b, and k×p>a×b; and a second conversion module, configured to convert the adjustment data into the display data.

In an embodiment of the disclosure, the adjustment data comprise luminance information of M×N second pixel groups arranged in a M×N matrix, in which each row comprises M second pixel groups, each column comprises N second pixel groups, each of the second pixel groups comprises k×p third pixels, and the luminance information of each of the second pixel groups comprises the luminance information of the k×p third pixels thereof;

the second conversion module is configured to convert the luminance information of M×N second pixel groups of the adjustment data into the luminance information of M×N second pixels.

In an embodiment of the disclosure, the luminance information of each first pixel comprises luminance information of the sub-pixels of this first pixel, the luminance information of each second pixel comprises luminance information of the sub-pixels of this second pixel, and the luminance information of each third pixel comprises luminance information of the sub-pixels of this third pixel;

the second conversion module comprises:

a first determination sub-module, configured to determine each of the second pixels of the M×N second pixels corresponding to respective second pixel group of M×N second pixel groups; and a second determination sub-module, configured to calculate average luminance of sub-pixels having a same color among a×b third pixels of each of the second pixel groups to obtain the luminance information of each of the second pixels.

In an embodiment of the disclosure, the delta pixel arrangement display device is a liquid crystal display device, and the luminance information is transmittance information.

In an embodiment of the disclosure, the acquisition unit comprises:

a first acquisition module, configured to acquire grayscale information of a*M×b*N first pixels arranged an a*M×b*N matrix; and a third conversion module, configured to converting the grayscale information of the first pixels into transmittance information of the first pixels;

the display unit comprises:

a fourth conversion module, configured to converting transmittance information of M×N second pixels into grayscale information of the second pixels; and a display module, configured to display the image according to the grayscale information of the second pixels.

At least one embodiment of the disclosure provides a delta pixel arrangement display device, comprising:

a memory, configured to store a set of program code, and a processor, configured to execute any image display method as described in the above embodiments according the program code.

Embodiments of the disclosure provide an image display method and an image display apparatus and a delta pixel arrangement display device. The image display method is applicable to the delta arranged display device which comprises M×N second pixels. During displaying the image, firstly, raw data of a frame of an image is acquired. In case that the raw data is strip pixels arrangement, it comprises luminance information of a*M×b*N first pixels. Then the luminance information of a*M×b*N first pixels are converted into the luminance information of M×N first pixels for displaying. That is, the raw data of the image with higher resolution is acquired, and display data of the image with lower resolution is obtained from the raw data of the image with higher resolution. The image display method of the disclosure can improve visual resolution and improve effects of image displaying, compared to conventionally acquiring the luminance information of M×N second pixels of the delta pixel arrangement display device directly.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

REFERENCE SIGNS

10: pixel; 11: first pixel; 13: third pixel; 21: first pixel group; 22: second pixel group; 100: strip pixel arrangement display device; 200: delta pixel arrangement display device.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Figure 2:
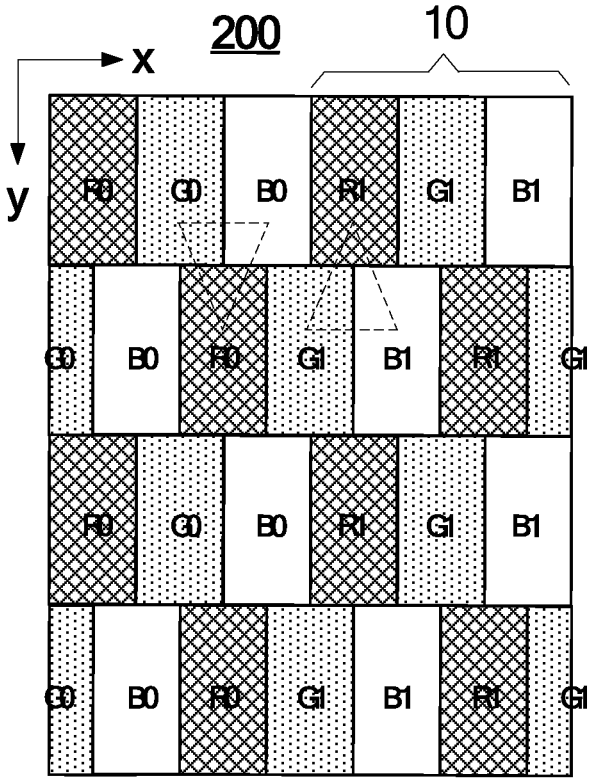
FIG. 2 is a schematic diagram of a conventional delta pixel arrangement display device.
Figure 3:
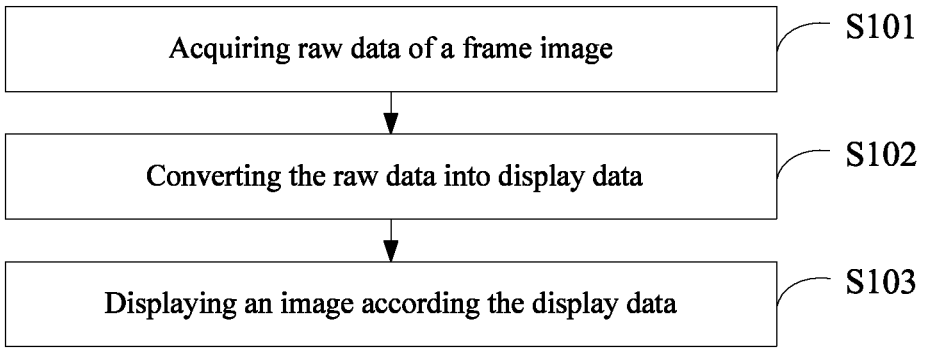
FIG. 3 is a schematic diagram of a display method according to an embodiment of the disclosure.

At least one of the embodiments of the disclosure provides an image display method applicable to a delta pixel arrangement display device. The delta pixel arrangement display device comprises M×N second pixels arranged in an M×N matrix, that is, a resolution of the delta pixel arrangement display device is M×N. For example, the delta pixel arrangement display device is illustrated as in FIG. 2. M=2 and N=4 is illustrated as an example, and the second pixel is a pixel 2 as illustrated in FIG. 2. As illustrated in FIG. 3, the display method comprises steps as follows.

Figure 1:
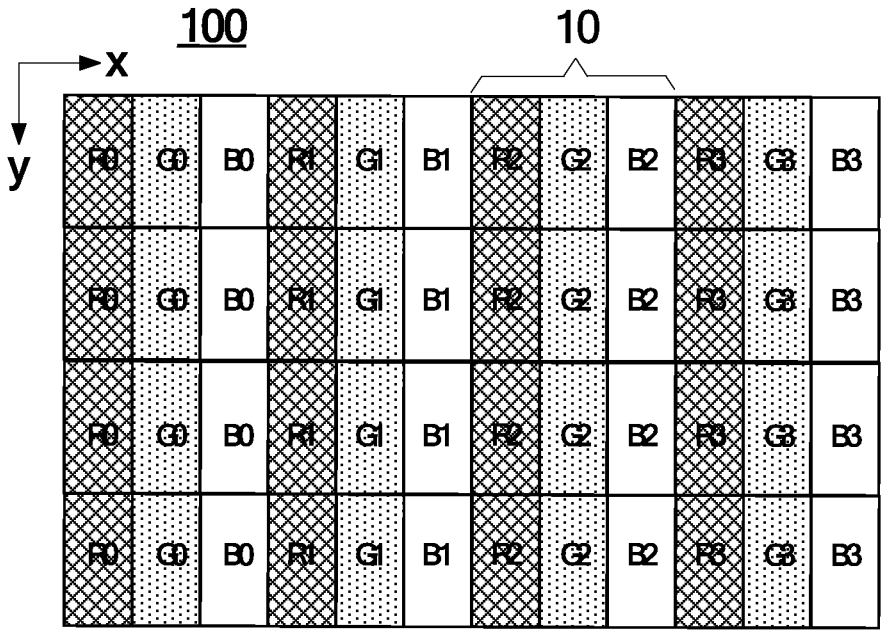
FIG. 1 is a schematic diagram of a conventional strip pixel arrangement display device.

Step 101, raw data of a frame of an image is acquired. The raw data comprise: luminance information of a*M×b*N first pixels arranged in an a*M×b*N matrix, wherein a≥1, b≥1, and a×b≠1. The first pixels are arranged in strip, and each of the first pixels at least comprises sub-pixels with three different colors RGB. The first pixels are arranged in an a*M×b*N matrix, that is, the first pixels are arranged to form a matrix with a*M columns and b*N rows, wherein each row comprises a*M first pixels, and each column comprises b*N first pixels. The first pixels are arranged in strip, that is, the first pixels can be arranged in arrangement as illustrated in FIG. 1. Each of the first pixels at least comprises sub-pixels with three different colors RGB, that is, the first pixel can comprise sub-pixels with three different colors R (red), G (green) and B (blue), or otherwise it can comprise sub-pixels with four different colors R (red), G (green), B (blue) and W (white), or otherwise it can comprise sub-pixels with four different colors R (red), G (green), B (blue) and Y (yellow). The first pixel comprising sub-pixels with three different colors R (red), G (green) and B (blue) is only for illustration, and the sub-pixels of the first pixel are not limited thereto.

In the image display method, a≥1, b≥1 and a×b≠1, each of a and b is a positive number greater than or equal to 1, and both a and b can be not 1 at the same time. Only a can be a positive number greater than 1 and b is equal to 1, or only b can be a positive number greater than 1 and a is equal to 1, or both of a and b are positive number greater than 1. The positive number can be a positive integer and also can be a positive fraction. It should be noted that the positive fraction is a fraction in lowest term and is a non integer.

Hereinafter an embodiment of the present disclosure will be described by taking a=2 and b=1 as an example. At this time, the raw data comprise: luminance information of 16 first pixels arranged in 4×4 matrix. The pixel arrangement is illustrated in FIG. 1.

Step 102, the raw data is converted into display data. The display data comprise luminance information of M×N second pixels. Each of the second pixels at least comprises respective sub-pixels of corresponding one of the first pixels. Regarding this embodiment, the luminance information of 16 first pixels is converted into the luminance information of 8 second pixels.

Each of the second pixels at least comprises respective sub-pixels of corresponding one of the first pixels. For example, the first pixel comprises sub-pixels with three different colors RGB, and then the second pixel can just comprises sub-pixels with three different colors RGB, and otherwise it can comprise sub-pixels with four different colors RGBY. Luminance information of a sub-pixel of the second pixel not belonging to the first pixel can be acquired directly rather than be obtained on basis of the luminance information of the sub-pixels of the first pixel. Other sub-pixels can be processed and displayed according to the display method of the embodiment of the disclosure.

It should be noted that, as illustrated in FIGS. 1 and 2, even lines of the delta pixel arrangement display device comprise two half sub-pixels. Luminance information of these two half sub-pixels can be obtained by converting the raw data. Or it can be preset or be same as display information of a adjacent sub-pixel with same color etc. A process method of the luminance information of these half sub-pixels is not limited to this embodiment of the disclosure.

Step 103, an image is displayed according to the display data. The number of pixels in the display device is M×N, and it corresponds to the number of second pixels comprised in the display data. The converted display data is displayed on the display device.

The embodiment of the disclosure provides an image display method applicable to the delta arranged display device. The delta arranged display device comprises M×N second pixels. During displaying the image, firstly, raw data of a frame of an image is acquired. In case that the raw data is strip pixels arrangement, it comprises luminance information of a*M×b*N first pixels. Then the luminance information of a*M×b*N first pixels are converted into the luminance information of M×N first pixels for displaying. That is, the raw data of the image with higher resolution is acquired, and display data of the image with lower resolution is obtained from the raw data of the image with higher resolution. The image display method of the disclosure can improve visual resolution and improve effects of image displaying, compared to conventionally acquiring the luminance information of M×N second pixels of the delta pixel arrangement display device directly.

Figure 5:
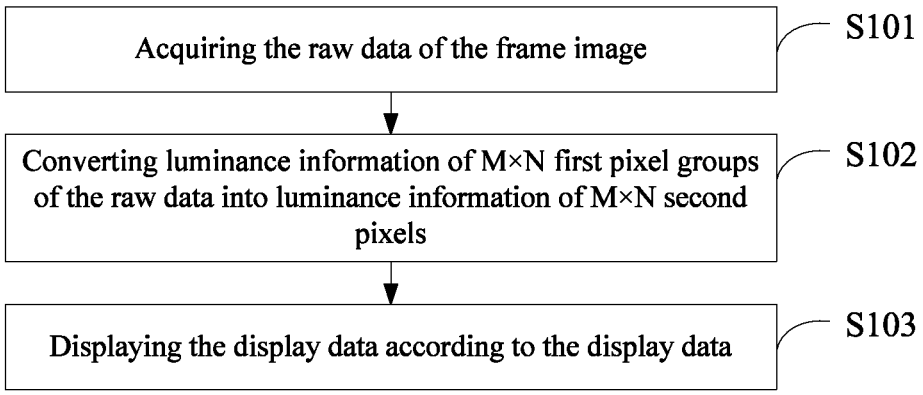
FIG. 5 is a schematic diagram of a display method according to another embodiment of the disclosure.

In an embodiment of the disclosure, both of a and b are positive integers. The raw data comprise luminance information of M×N first pixel group arranged in a M×N matrix, in which each row comprises M first pixel groups, each column comprises N first pixel groups, each of the first pixel groups comprises a×b first pixels, and the luminance information of each first pixel group comprises the luminance information of a×b first pixels of this first pixel group. As illustrated in FIG. 5, step 102 comprises converting luminance information of M×N first pixel groups of the raw data into luminance information of M×N second pixels.

Figure 4:
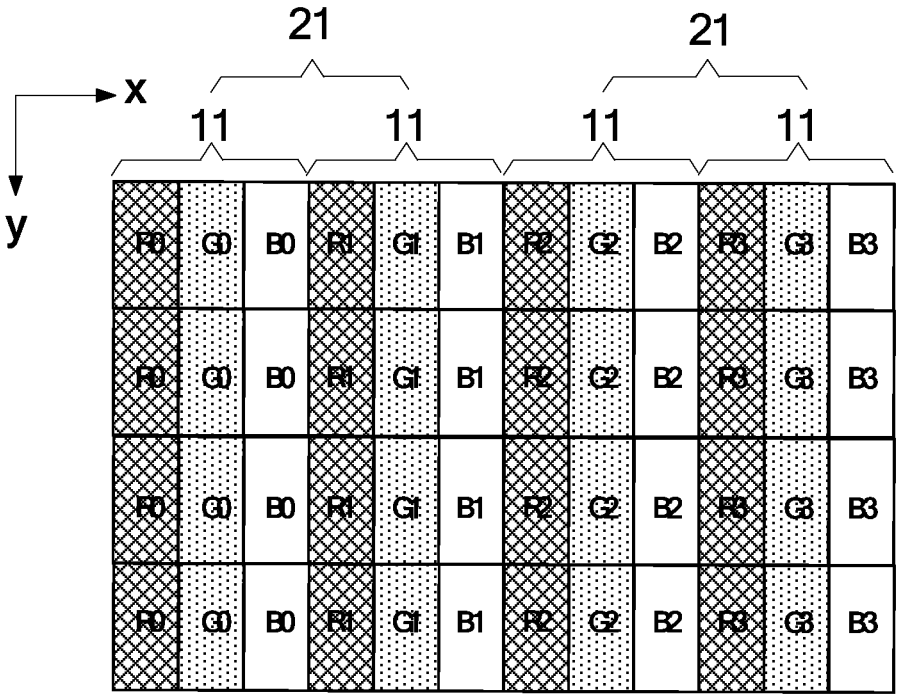
FIG. 4 is a schematic diagram of a first pixel arrangement of raw data according to an embodiment of the disclosure.

For example, as illustrated in FIG. 4, a case in which a=2, b=1, M=2 and N=4 is illustrated as an example. The raw data comprise the luminance information of 8 first pixel groups 21 arranged in a 2×4 matrix, in which along the direction of x axis, each row comprises two first pixel groups 21 and each first pixel group 21 comprises one first pixel 11, and along the direction of y axis, each column comprises 4 first pixel groups 21 and each first pixel group 21 comprises 2 first pixels 11. That is, the raw data comprise the luminance information of 8 first pixel groups 21 and each first pixel group 21 comprises luminance information of 2 first pixels 11. That is, the raw data comprise the luminance information of 16 first pixels 11.

Step 102: the luminance information of M×N first pixel groups of the raw data is converted into the luminance information of M×N second pixels, that is, the luminance information of 8 first pixel groups is converted into the luminance information of 8 second pixels. For example, because the first pixel group is arranged in an M×N (that is 2×4) matrix, the second pixels is arranged in an M×N (that is 2×4) matrix. Respective first pixel group corresponds to one second pixel, and thus the luminance information of M×N second pixels are obtained.

According to the image display method of the disclosure, if the luminance information of a*M×b*N first pixels comprised in the raw data is an integral multiple of M×N second pixels of the pixels in the delta pixel arrangement display device in the row direction or in the column direction, the first pixels are divided into M×N first pixel groups in the row direction or in the column direction, and the luminance information of respective second pixels is obtained according to the luminance information of respective first pixel groups correspondingly.

Figure 6:
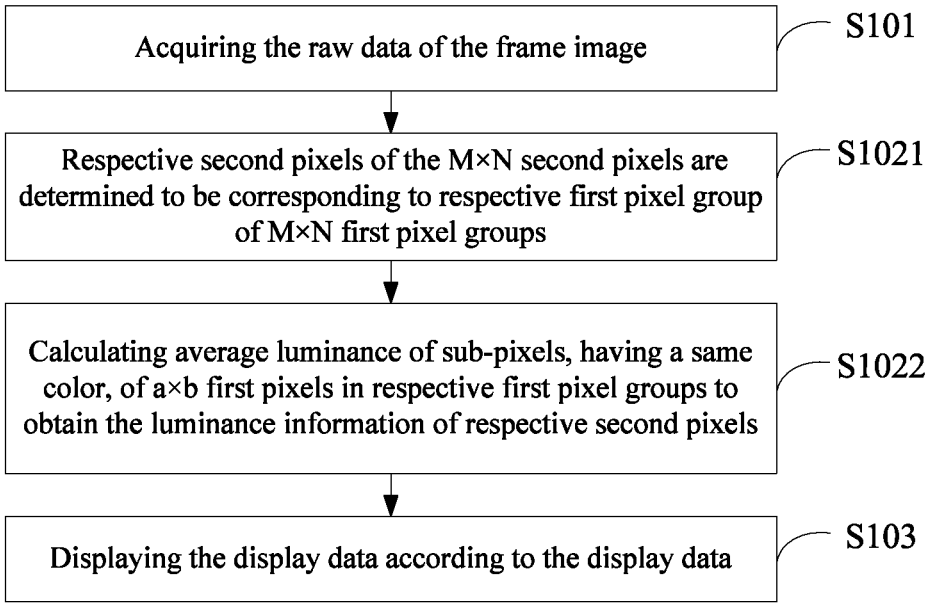
FIG. 6 is a schematic diagram of a display method according to yet another embodiment of the disclosure.

In an embodiment of the disclosure, the luminance information of each first pixel comprises luminance information of respective the sub-pixels of this first pixel, and the luminance information of each second pixel comprises luminance information of respective sub-pixels of this second pixel. As illustrated in FIG. 6, the above step 102 comprises following steps.

Step 1021, respective second pixels of the M×N second pixels are determined to be corresponding to respective first pixel group of M×N first pixel groups.

For example, a first pixel group (x, y) can correspond to a second pixel (x, y), that is, a first pixel group in y-th row and x-th column corresponds to a second pixel in y-th row and x-th column.

Of course, a first pixel group being converted into a second pixel group correspondingly is not limited to the manner of coordinates as mentioned above, and it is just illustrated as an example for describing the embodiments of the disclosure.

Step 1022, average luminance of sub-pixels, having a same color, of a×b first pixels in respective first pixel groups are calculated to obtain the luminance information of respective second pixels. The first pixel comprising three sub-pixels RGB and the second pixel comprising three sub-pixels RGB is taken as an example for illustrating an embodiment of the disclosure.

As illustrated in FIG. 4, the first pixel group 21 located on the first row and the first column comprises two first pixels 11, and respective first pixel 11 comprises three sub-pixels RGB. Average luminance R' of red sub-pixels of the first pixel group is equal to an average value of the red sub-pixel R0 and the red sub-pixel R1, that is R'=(R0+R1)/2. Similarly, average luminance G' of the green sub-pixels and average luminance B' of the blue sub-pixels are obtained, so that the luminance information of the second pixel located on the first row and the first column comprises the average luminance R' of the red sub-pixels, the average luminance G' of the green sub-pixels and the average luminance B' of the blue sub-pixels.

It should be noted that, the first pixel group comprising two first pixels is illustrated as an example in the above embodiment, and thus R'=(R0+R1)/2. Of course, the first pixel group also can comprises three or four first pixels, and if the first pixel group comprises three first pixels, R'=(R0+R1+R2)/3.

Figure 7:
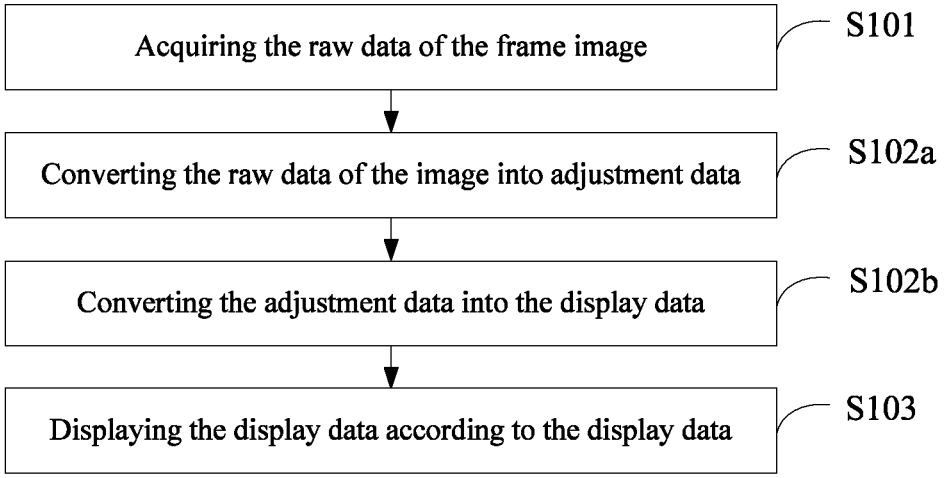
FIG. 7 is a schematic diagram of a display method according to yet another embodiment of the disclosure.

In an embodiment of the disclosure, at least one of a and b is a positive fraction. As illustrated in FIG. 7, the step 102 comprises following steps.

Step 102*a*, converting the raw data into adjustment data. The adjustment data comprise luminance information of k*M×p*N third pixels arranged in a k*M×p*N matrix, where k is an integer equal to or greater than a, p is an integer equal to or greater than b, and k×p>a×b.

Figure 8:
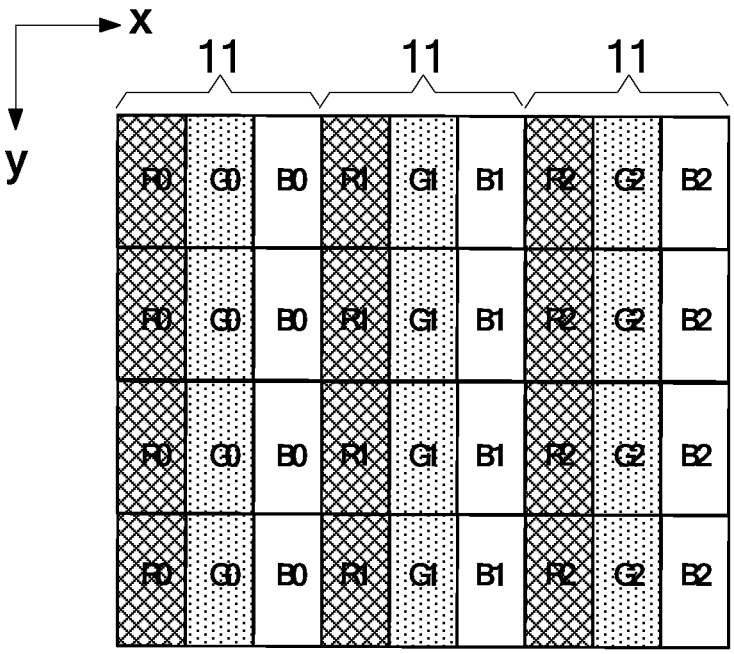
FIG. 8 is a schematic diagram of a first pixel arrangement of the raw data according to another embodiment of the disclosure.
Figure 9:
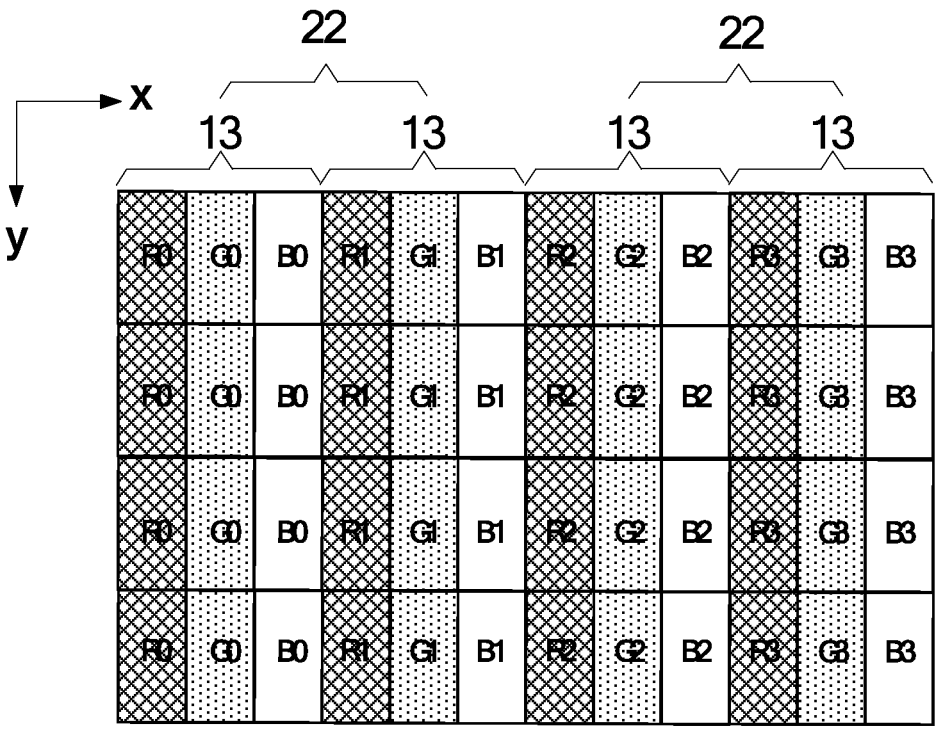
FIG. 9 is a schematic diagram of a third pixel arrangement of adjustment data according to an embodiment of the disclosure.

A being a positive faction, b being 1 and p being an integer equal to b is illustrated as an example for illustration. The delta pixel arrangement display device is illustrated in FIG. 2, comprising 8 second pixels arranged in a 2×4 matrix. As illustrated in FIG. 8, a case in which a=3/2 and b=1 is illustrated as an example, and the raw data comprise luminance information of 12 first pixels 11 arranged in a 3×4 matrix. Then, the raw data is converted into adjustment data. A case in which k=2 and p=1 is illustrated as an example. As illustrated in FIG. 9, the adjustment data can be luminance information of 16 third pixels 13 arranged in a 4×4 matrix.

For example, an interpolation and the like can be utilized to convert the raw data into the adjustment data. In an embodiment of the disclosure, respective k and p are equal to 2. That is to say, the number of the third pixels comprised in the adjustment data in the row direction or the column direction is two times of the number of the second pixels in the delta pixel arrangement display device in the row direction or the column direction, so as to enhancing processing speed while a better display effect being achieved in the delta pixel arrangement display device.

Step 102*b*, converting the adjustment data into display data.

Figure 10:
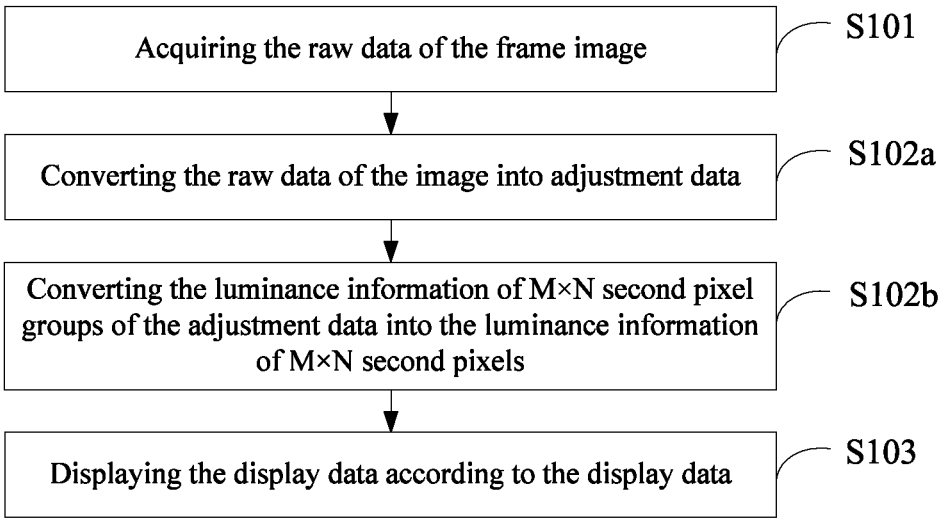
FIG. 10 is a schematic diagram of a display method according to another embodiment of the disclosure.

For example, the adjustment data comprise luminance information of M×N second pixel groups arranged in an M×N matrix, in which each row comprises M second pixel groups, each column comprises N second pixel groups, each of the second pixel groups comprises k×p third pixels, and the luminance information of each of the second pixel groups comprises the luminance information of the k×p third pixels. As illustrated in FIG. 10, the above mentioned step 102*b* comprises converting the luminance information of M×N second pixel groups of the adjustment data into the luminance information of M×N second pixels.

For example, as illustrated in FIG. 9, a case in which k=2, p=1, M=2 and N=4 is illustrated as an example. The adjustment data comprise the luminance information of 8 second pixel groups 22 arranged in a 2×4 matrix, in which along the direction of x axis, each row comprises two second pixel groups 22 and along the direction of y axis, each column comprises 4 second pixel groups 22. Each second pixel group 22 comprises 2 third pixels 13. That is, the adjustment data comprise the luminance information of 8 second pixel groups 22 and each second pixel group 22 comprises luminance information of 2 third pixels 13, i.e. the adjustment data comprise the luminance information of 16 third pixels 13.

Figure 11:
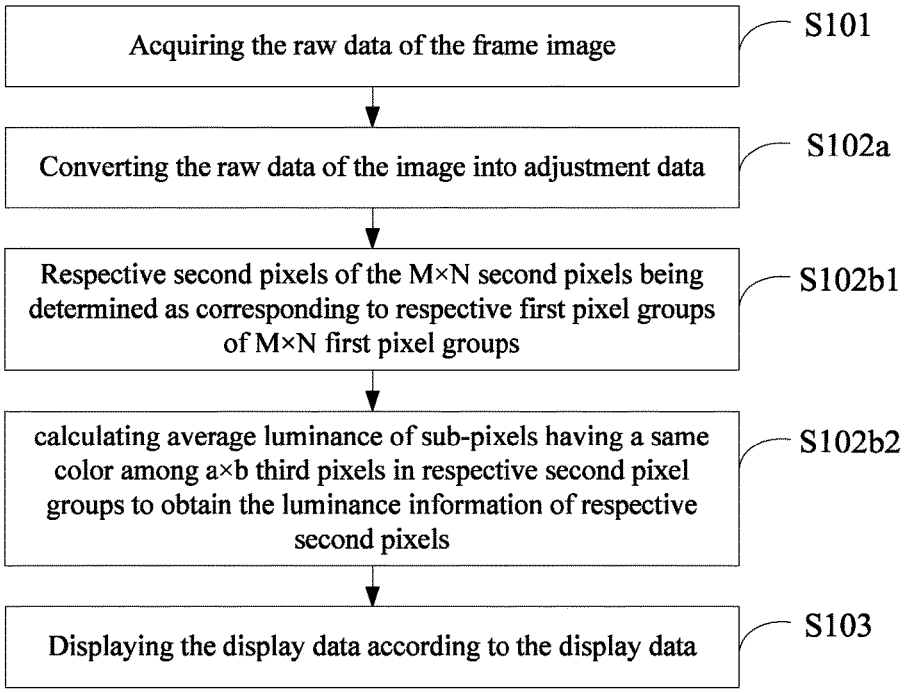
FIG. 11 is a schematic diagram of a display method according to yet another embodiment of the disclosure.

In an embodiment of the disclosure, the luminance information of each first pixel comprises luminance information of respective sub-pixels of this first pixel, the luminance information of each second pixel comprises luminance information of respective sub-pixels of this second pixel, and the luminance information of each third pixel comprises luminance information of respective sub-pixels of this third pixel. As illustrated in FIG. 11, the above step 102*b* comprises following steps.

Step 102*b*1, respective second pixels of the M×N second pixels are determined as corresponding to respective first pixel groups of M×N first pixel groups.

For example, a second pixel group (x, y) correspond to a second pixel (x, y), i.e. a second pixel group in y-th row and x-th column corresponds to a second pixel in y-th row and x-th column.

Of course, converting a second pixel group into a second pixel correspondingly is not limited to the manner of coordinates as mentioned above, and it is just illustrated as an example for illustrating the embodiments of the disclosure.

Step 102*b*2, calculating average luminance of sub-pixels having a same color among a×b third pixels in respective second pixel groups to obtain the luminance information of respective second pixels.

The first pixel comprising three sub-pixels RGB and the second pixel comprising three sub-pixels RGB is taken as an example for illustrating one embodiment of the disclosure.

As illustrated in FIG. 9, the second pixel group 22 located on a first row and a first column comprises two third pixels 13, and each third pixel 13 comprises three sub-pixels RGB. Average luminance R' of red sub-pixels in the second pixel group is equal to an average value of the red sub-pixel R0 and the red sub-pixel R1, that is R'=(R0+R1)/2. Similarly, average luminance G' of the green sub-pixels and average luminance B' of the blue sub-pixels are obtained, so that the luminance information of the second pixel located on the first row and the first column comprises the average luminance R' of the red sub-pixels, the average luminance G' of the green sub-pixels and the average luminance B' of the blue sub-pixels.

It should be noted that, the second pixel group comprising two third pixels is illustrated as an example in the above embodiment, and thus R'=(R0+R1)/2. Of course, the second pixel group also can comprises three or four third pixels, and if the second pixel group comprises three first pixels, R'=(R0+R1+R2)/3.

For example, if a=e/d, k=xda, where x, e, d are integers greater than 1 respectively and e>d.

In a case of b=u/k, then p=ykb, where y, u, k are integers greater than 1 respectively and u>k. It should be noted that, a=e/d and b=u/k, where both of e/d and u/k are a faction in lowest term. The number of the third pixels comprised in each row or each column of the adjustment data is integral multiple of the number of the first pixels of each row or each column of the raw data. Converting the raw data into the adjustment data can be achieved by multiply adjusting the raw data, and converting the adjustment data into the display data can be achieved by averaging the adjustment data.

A being a positive fraction, b being 1 and p being a positive integer equal to b is illustrated as an example. For example, taking M=2, N=4, a=3/2, b=1, x=1 and y=1 as an example, then k=3.

Figure 12:
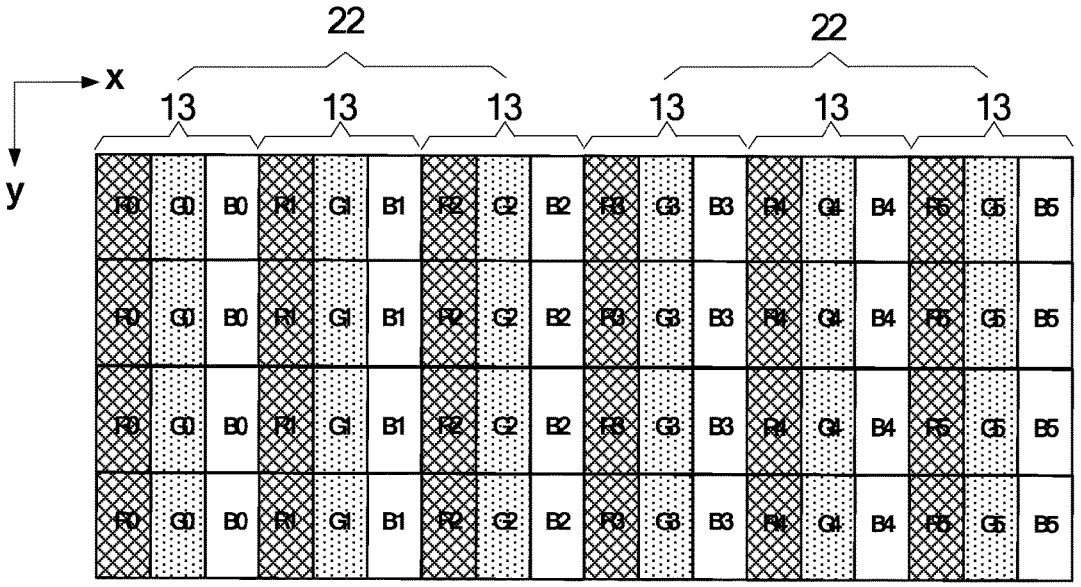
FIG. 12 is a schematic diagram of a third pixel arrangement of adjustment data according to another embodiment of the disclosure.

As illustrated in FIG. 8, the raw data comprise luminance information of 12 first pixels arranged in a 3×4 (i.e. 3/2×M×N) matrix. As illustrated in FIG. 2, the delta pixel arrangement display device comprises 8 second pixels arranged in a 2×4 matrix. That is, M=2, N=4, a=3/2 and b=1, and x=1 is illustrated as an example, then k=2×3/2=3. That is, the adjustment data comprise luminance information of 24 third pixels arranged in a 6×4 (3×M×N) matrix, as illustrated in FIG. 12. The number of third pixels comprised in each row among the adjustment data is two times of the number of first pixels comprised in each row among the raw data, and is three times of the second pixels comprised in each row of the delta pixel arrangement display device.

The number of the third pixels comprised in each row or each column among the adjustment data is an integral multiple of the number of the first pixels of each row among the raw data, and thus converting the raw data into the adjustment data can be achieved by multiply adjusting the raw data to obtain the adjustment data by conversion, so as to simplify the process. The number of third pixels comprised in each row of the adjustment data is an integral multiple of the number of second pixels comprised in each row of the delta pixel arrangement display device, to simplify the process.

Of course, the adjustment data also can be luminance information of 16 third pixels arranged in a 4×4 matrix. That is, the number of the third pixels comprised in each row among the adjustment data is 4/3 times of the number of the first pixels comprised in each row among the raw data and is two times of the number of the second pixels in each row of the delta pixel arrangement display device. At this time, a process of converting the raw data into the adjustment data is more complicated. Thus, embodiments of the disclosure are described herein to illustrate the technical solution of the disclosure in connection with drawings.

In an embodiment of the disclosure, the delta pixel arrangement display device is a liquid crystal display device. The luminance information is transmittance information for example. The luminance information can also be saturation information, gamut information and the like. In this disclosure, the luminance information being the transmission information is illustrated as an example for illustration.

Figure 13:
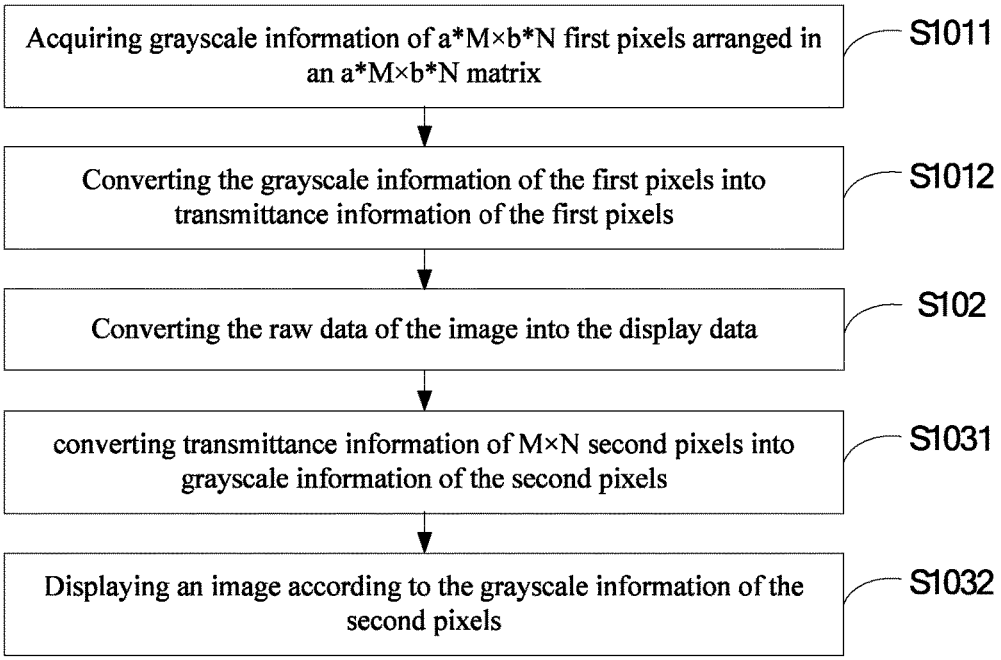
FIG. 13 is a schematic diagram of a display method according to yet another embodiment of the disclosure.

Further, if the delta pixel arrangement display device is a liquid crystal display device. As illustrated in FIG. 13, above mentioned step 101 comprises:

Step 1011, acquiring grayscale information of a*M×b*N first pixels arranged in an a*M×b*N matrix; and Step 1012, converting the grayscale information of the first pixels into transmittance information of the first pixels.

The above mentioned step 103 comprises:

Step 1031, converting transmittance information of M×N second pixels into grayscale information of the second pixels; and Step 1032, displaying an image according to the grayscale information of the second pixels.

Due to a nonlinear relationship between transmittance and grayscale of the display device, during image display process, the grayscale information is converted into transmittance information, and finally, the transmittance information is converted into grayscale information again for display, to further improve display quality.

Hereinafter, an embodiment of the disclosure provides a display apparatus adapted to the image display method of the embodiment of the disclosure. It should be noted that, respective function units comprised in following apparatus can execute respective steps of the above mentioned method, so the respective function units of the apparatus will not be described in detail in following embodiments.

Figure 14:
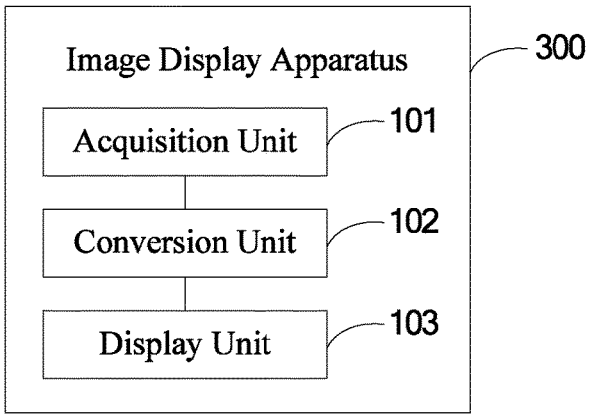
FIG. 14 is a schematic diagram of a display apparatus according to an embodiment of the disclosure.

At least one embodiment of the disclosure provides an image display apparatus, applicable to a delta pixel arrangement display device. The delta pixel arrangement display device comprises M×N second pixels arranged in an M×N matrix. As illustrated in FIG. 14, the image display apparatus 300 comprises an acquisition unit 101, a conversion unit 102 and a display unit 103.

The acquisition unit 101 is configured to acquire raw data of a frame of an image. The raw data comprise: luminance information of a*M×b*N first pixels arranged in an a*M×b*N matrix, where a≥1, b≥1 and a×b≠1. The first pixels are arranged in strip and each of the first pixels at least comprises sub-pixels with three different colors RGB.

The conversion unit 102 is configured to convert the raw data into display data. The display data comprise luminance information of M×N second pixels. The second pixel at least comprises respective pixels of the first pixel.

The display unit 103 is configured to display an image according to the display data.

It should be noted that, the image display device can be a source driver of the delta pixel arrangement display device according to the embodiment of the disclosure.

At least one of the embodiments of the disclosure provides an image display apparatus applicable to a delta pixel arrangement display device. The delta pixel arrangement display device comprises M×N second pixels. During displaying images, firstly, raw data of a frame of an image is acquired, wherein the raw data is luminance information of a*M×b*N first pixels arranged in strip. Then the luminance information of the a*M×b*N first pixels is converted into the luminance information of M×N first pixels in order to be displayed, that is, the raw data of the image with higher resolution is acquired and the display data of the image with lower resolution is obtained from the raw data of the image with higher resolution. The image display apparatus according to the disclosure can improve visual resolution and improve effects of image displayed, compared to conventionally acquiring the luminance information of M×N second pixels of the delta pixel arrangement display device directly.

In one embodiment of the disclosure, both of a and b are positive integers. The raw data comprise luminance information of M×N first pixel groups arranged in an M×N matrix, in which each row comprises M first pixel groups, each column comprises N first pixel groups, each of the first pixel groups comprises a×b first pixels, and the luminance information of each firs pixel group comprises the luminance information of a×b first pixels comprised therein. The conversion unit 102 is configured to convert luminance information of M×N first pixel groups of the raw data into luminance information of M×N second pixels.

Figure 15:
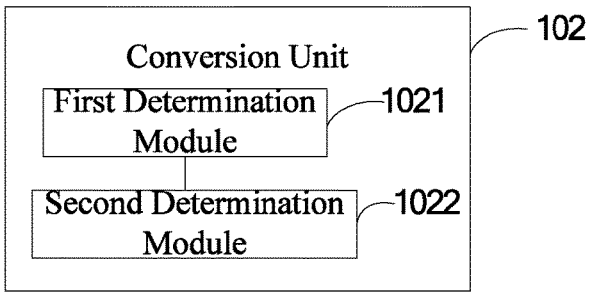
FIG. 15 is a schematic diagram of a conversion unit according to an embodiment of the disclosure.

In one embodiment of the disclosure, the luminance information of each first pixel comprises luminance information of respective sub-pixels of this first pixel, and the luminance information of each second pixel comprises luminance information of respective sub-pixels of this second pixel. As illustrated in FIG. 15, the conversion unit 102 comprises:

a first determination module 1021 configured to determine respective second pixels of the M×N second pixels corresponding to respective first pixel group of M×N first pixel groups; and a second determination module 1022, configured to calculate average luminance of sub-pixels, having a same color, of a×b first pixels of respective first pixel groups to obtain average luminance, so that the luminance information of respective second pixels is obtained.

Figure 16:
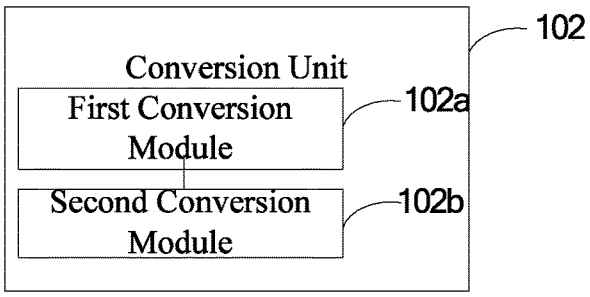
FIG. 16 is a schematic diagram of a conversion unit according to another embodiment of the disclosure.

In one embodiment of the disclosure, at least one of a and b is a positive fraction. As illustrated in FIG. 16, the conversion unit 102 comprises:

a first conversion module 102*a*, configured to convert the raw data into adjustment data, wherein the adjustment data comprise luminance information of k*M×p*N three pixels arranged in a k*M×p*N matrix, where k is an integer equal to or greater than a, p is an integer equal to or greater than b, and k×p>a×b; and a second conversion module 102*b*, configured to convert the adjustment data into display data.

In an embodiment of the disclosure, the adjustment data comprise luminance information of M×N second pixel groups arranged an M×N matrix, in which each row comprises M second pixel groups, each column comprises N second pixel groups, each of the second pixel groups comprises k×p third pixels, and the luminance information of each of the second pixel groups comprises the luminance information of the k×p third pixels of this second pixel group. The second conversion module is configured to convert the luminance information of M×N second pixel groups among the adjustment data into the luminance information of M×N second pixels.

Figure 17:
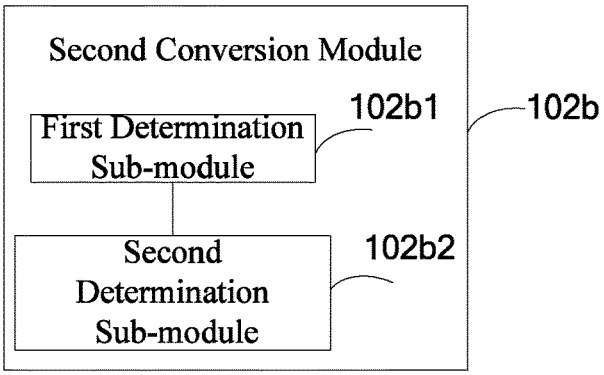
FIG. 17 is a schematic diagram of a second conversion module according to an embodiment of the disclosure.

In an embodiment of the disclosure, the luminance information of each first pixel comprises luminance information of respective sub-pixels of this first pixel, the luminance information of each second pixel comprises luminance information of respective sub-pixels of this second pixel, and the luminance information of each third pixel comprises luminance information of respective sub-pixels of this third pixel. For example, as illustrated in FIG. 17, the second conversion module comprises:

a first determination sub-module **102*b*1, configured to determine respective second pixels of the M×N second pixels a corresponding to respective first pixel group of M×N first pixel groups; and a second determination sub-module 102*b*2**, configured to calculate average luminance of sub-pixels, having a same color, of a×b third pixels of respective second pixel groups to obtain average luminance, so that the luminance information of respective second pixels is obtained.

In an embodiment of the disclosure, the delta pixel arrangement display device is a liquid crystal display device, and the luminance information is transmittance information.

Figure 18:
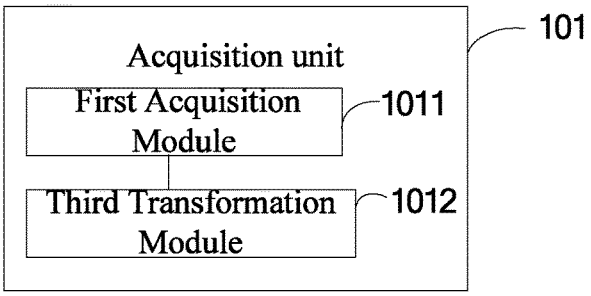
FIG. 18 is a schematic diagram of an acquisition unit according to an embodiment of the disclosure.

In an embodiment of the disclosure, as illustrated in FIG. 18, the acquisition unit 101 comprises:

a first acquisition unit 1011, configured to acquire grayscale information of a*M×b*N first pixels arranged in an a*M×b*N matrix; and a third conversion unit 1012, configured to convert the grayscale information of the first pixels into transmittance information of the first pixels.

Figure 19:
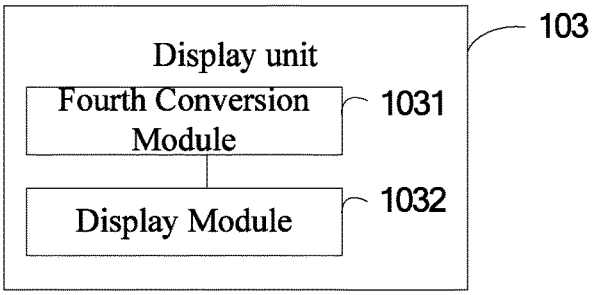
FIG. 19 is a schematic diagram of a display unit according to an embodiment of the disclosure.

As illustrated in FIG. 19, the display unit 103 comprises:

a fourth conversion module 1031, configured to convert transmittance information of M×N second pixels into grayscale information of the second pixels; and a display module 1032, configured to display an image according to the grayscale information of the second pixels.

Figure 20:
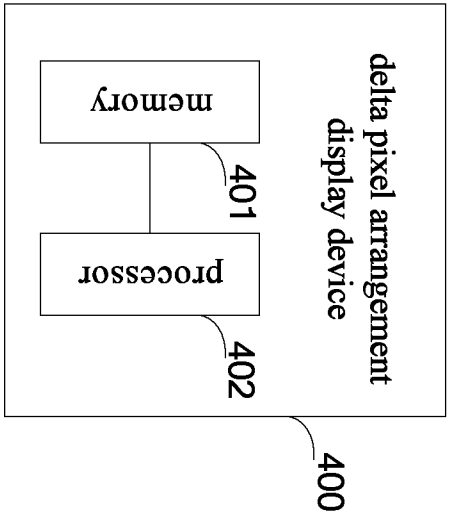
FIG. 20 is a schematic diagram of a delta pixel arrangement display device according to an embodiment of the disclosure.

At least one embodiment of the disclosure provides a delta pixel arrangement display device 400, as illustrated in FIG. 20, comprising:

a memory 401, configured to store a set of program code, and a processor 402, configured to execute the set of program code stored in the memory to perform the image display method according to the embodiments of the disclosure.

It should be noted that, details of partial function modules of the delta pixel arrangement display device according to the embodiments of the disclosure can be referred to corresponding contents of the embodiments of the method of the disclosure, and will be not elaborated in this embodiment.

Those skilled in the art can clearly understand that, for convenience and simple description, a division of above mentioned respective function modules is illustrated as an example for illustration, by description of above mentioned embodiments, and in practice, the above mentioned functions can be distributed in different function modules according to actual requirements, that is, an internal structure of an apparatus can be divided into different function modules, to complete entire or partial functions as described above. Operation processes of the above-described system, apparatus and units can be referred to corresponding processes of the above mentioned embodiments and will be not elaborated here According to the embodiments of the disclosure, it should be understood that, the disclosed system, apparatus and method can be implemented in other manners. For example, the above described apparatus are only exemplary. For example, the division of the modules or units is only a logical division, and in fact, they can be divided in other division manners. For example, a plurality of units or assemblies can be combined or can be integrated into another system, or some features can be omitted, or are not executed. Furthermore, indirectly or directly mutual coupling or communication connection as illustrated or discussed can be indirectly coupling or communication connection can be between apparatuses or units through some ports and can be of electrical, mechanical or other forms.

The units illustrated as separated components can be separated or can be not separated physically. The component displayed as a unit can be or can be not a physical unit, that is, it can be located at a location, or can be distributed over a plurality of network units. Some or all of the units can be selected to implement the embodiments according to actual requirements.

Furthermore, the respective function units of the embodiments of the disclosure can be integrated into one processor unit, the respective function units also can exist separately, and two or more of the function units also can be integrated into one unit. The abovementioned integrated units can be implemented through hardware and can be implemented through software function units.

The integrated units can be stored in a computer readable memory medium when they are implemented through software function units and used or sold as a stand-alone product. Based on this understanding, the technical solutions of the disclosure can be substantively embodied by a software product, or a part which contributes to prior art can be embodied by a software product, or a part or entire technical solutions of the disclosure can be embodied by a software product. The software product is stored in a memory medium, including some instructions to cause a computer device (which can be a personal computer, a server or a network device) or a processor to execute a part or all of the operations of the methods of the respective embodiments of the disclosure. The above mentioned memory medium comprises U flash disk, removable hard disk, ROM (Read-Only Memory), RAM (Random Access Memory), magnetic disk or optical disk or other medium that can store program code.

The foregoing are merely exemplary embodiments of the disclosure, but are not used to limit the protection scope of the disclosure. The protection scope of the disclosure shall be defined by the attached claims.

This application claims the priority of Chinese Patent Application No. 201510317250.2 filed on Jun. 10, 2015, the disclosure of which is hereby entirely incorporated by reference.

What is claimed is:

1. An image display method adapted to a delta pixel arrangement display device, the delta pixel arrangement display device comprising M×N second pixels arranged in form of an M×N matrix, the display method comprising:

acquiring raw data of a frame of an image, wherein the raw data comprise luminance information of a*M×b*N first pixels arranged in form of an a*M×b*N matrix, where a≥1, b≥1 and a×b≠1, the first pixels are arranged in strip and each of the first pixels at least comprises sub-pixels with three different colors RGB;

converting the raw data of the image into display data, wherein the display data comprise luminance information of M×N second pixels, and each of the second pixels at least comprises respective sub-pixels in corresponding one of the first pixels; and displaying the image according to the display data;

wherein at least one of a and b is a positive fraction; and converting the raw data of the image into the display data comprise:

converting the raw data into adjustment data, wherein the adjustment data comprise luminance information of k*M×p*N third pixels arranged in form of a k*M×p*N matrix, where k is an integer equal to or greater than a, p is an integer equal to or greater than b, and k×p>a×b; and converting the adjustment data into the display data; and wherein the adjustment data comprise luminance information of M×N second pixel groups arrange in form of an M×N matrix, in which each row of the adjustment data comprise M second pixel groups, each column of the adjustment data comprise N second pixel groups, each of the second pixel groups, column k×p third pixels, and the luminance information of each of the second pixel groups comprises the luminance information of the k×p third pixels thereof;

converting, the adjustment data into the display data comprise:

converting the luminance information of M×N second pixel groups of the adjustment date into the luminance information of M×N second pixels.

2. The image display method according to claim 1 , wherein both of a and b are positive integers;

the raw data comprise luminance information of M×N first pixel group arranged in form of an M×N matrix, wherein each row of the matrix comprises M first pixel groups, each column of the matrix comprises N first pixel groups, each of the first pixel groups comprises a×b first pixels, and the luminance information of each of the firs pixel groups comprises luminance information of the a×b first pixels thereof;

converting the raw data of the image into the display data comprise converting the luminance information of M×N first pixel groups of the raw data into the luminance information of M×N second pixels respectively.

3. The image display method according to claim 2, wherein the luminance information of each first pixel comprises luminance information of respective sub-pixels of this first pixel, and the luminance information of each second pixel comprises luminance information of respective sub-pixels of this second pixel;

converting the luminance information of the M×N first pixel groups of the raw data into the luminance information of the M×N second pixels comprises:

determining respective second pixels of the M×N second pixels and their corresponding first pixel groups of the M×N first pixel groups; and calculating average luminance of sub-pixels, having a same color, of a×b first pixels of respective first pixel groups to obtain the luminance information of respective the second pixels.

4. The image display method according to claim 1, wherein the luminance information of the third pixels is obtained from the luminance information of the first pixels by interpolation.

5. The image display method according claim 1, wherein the luminance information of each first pixel comprises luminance information of respective sub-pixels of this first pixel, the luminance information of each second pixel comprises luminance information of respective sub-pixels of this second pixel, and the luminance information of each third pixel comprises luminance information of respective sub-pixels of this third pixel;

converting the luminance information of the M×N second pixel groups of the adjustment data into the luminance information of the M×N second pixels comprises determining respective second pixels of the M×N second pixels and their corresponding second pixel group of the M×N second pixel groups; and calculating average luminance of sub-pixels, having a same color, of a×b third pixels of respective second pixel groups to obtain the luminance information of respective second pixels.

6. The image display method according to claim 1, wherein the delta pixel arrangement display device is a liquid crystal display device, and the luminance information is transmittance information.

7. The image display method according to claim 6, wherein acquiring the raw data of the fame of image comprises:

acquiring grayscale information of the a*M×b*N first pixels arranged in form of the a*M×b*N matrix; and converting the grayscale information of the first pixels into transmittance information of the first pixels; and displaying the image according to the display data comprises:

converting transmittance information of M×N second pixels into grayscale information of the second pixels; and displaying the image according to the grayscale information of the second pixels.

8. A delta pixel arrangement display device, comprising;

a memory, configured to store a set of program code, and a processor, configured to execute the program code to perform the image display method of claim 1.

9. An image display apparatus adapted to a delta pixel arrangement display device, the delta pixel arrangement display device comprising M×N second pixels arranged in form of an M×N matrix, the image display apparatus comprising:

an acquisition unit, configured to acquire raw data of a frame of image, wherein the raw data comprise luminance information of a*M×b*N first pixels arranged in form of an a*M×b*N matrix, where a≥1, b≥1 and a×b≠1, the first pixels are arranged in strip and each of the first pixels at least comprises sub-pixels with three different colors RGB;

a conversion unit, configured to convert the raw data into display data, the display data comprising luminance information of M×N second pixels, and each of the second pixels at least comprising respective sub-pixels of corresponding one of the first pixel; and a display unit, configured to display the image according to the display data; and wherein at least one of a and b is a positive fraction;

the conversion unit comprises:

a first conversion module, configured to convert the raw data into adjustment data, the adjustment data comprising luminance information of k*M×p*N third pixels arranged in form of a k*M×p*N matrix, where k is an integer equal to or greater than a, p is an integer equal to or greater than b, and k×p>a×b; and a second conversion module, configured to convert the adjustment data into the display data; and wherein the adjustment data comprise luminance information of M×N second pixel groups arranged in form of an M×N matrix, in which each row of the matrix comprises M second pixel groups, each column of the matrix comprises N second pixel groups, each of the second pixel groups comprises k×p third pixels, and the luminance information of each of the second pixel groups comprises the luminance information of the k×p third pixels thereof;

the second conversion module is configured to convert the luminance information of, M×N second pixel groups of the adjustment data into the luminance information of M×N second pixels.

10. The image display apparatus according to claim 9, wherein both of a and b are positive integers, the raw data comprise luminance information of M×N first pixel group arranged in form of an M×N matrix, in which each row of the matrix comprises M first pixel groups, each column of the matrix comprises N first pixel groups, each of the first pixel groups comprises a×b first pixels, and the luminance information of each of the firs pixel groups comprise the luminance information of a×b first pixels thereof, and the conversion unit is configured to convert luminance information of M×N first pixel groups of the raw data into luminance information of M×N second pixels.

11. The image display apparatus according to claim 10, wherein the luminance information of each first pixel comprises luminance information of respective sub-pixels of this first pixel, and the luminance information of each second pixel comprises luminance information of respective sub-pixels of this second pixel;

the conversion unit comprises:

a first determination module, configured to determine respective second pixels of the M×N a second pixels and their corresponding first pixel group of M×N first pixel groups; and a second determination module, configured to calculate average luminance of sub-pixels, having a same color, of a×b first pixels of respective first pixel groups to obtain the luminance information of respective second pixels.

12. The image display apparatus according to claim 10, wherein the delta pixel arrangement display device is a liquid crystal display device, and the luminance information is transmittance information;

the acquisition unit comprises:

a first acquisition module, configured to acquire grayscale information of the a*M×b*N first pixels arranged in form of the a*M×b*N matrix; and a third conversion unit, configured to convert the grayscale information of the first pixels into transmittance information of the first pixels;

the display unit comprises:

a fourth conversion module, configured to convert transmittance information of the M×N second pixels into grayscale information of the second pixels; and a display module, configured to display the image according to the grayscale information of the second pixels.

13. The image display apparatus according to claim 9, wherein the first conversion module is configured to interpolate the raw data of the image, so as to convert the raw data into the adjustment data.

14. The image display apparatus according to claim 9, wherein the luminance information of each first pixel comprises luminance information of respective sub-pixels of this first pixel, the luminance information of each second pixel comprises luminance information of respective sub-pixels of this second pixel, and the luminance information of each third pixel comprises luminance information of respective sub-pixels of this third pixel;

the second conversion module comprises:

a first determination sub-module, configured to determine respective second pixels of the M×N second pixels and their corresponding second pixel group of M×N second pixel groups; and a second determination sub-module, configured to calculate average luminance of sub-pixels, having a same color, of a×b third pixels of respective second pixel groups to obtain the luminance information of respective second pixels.

15. The image display apparatus according to claim 9, wherein the delta pixel arrangement display device is a liquid crystal display device, and the luminance information is transmittance information.

16. The image display apparatus according to claim 15, wherein the acquisition unit comprises:

a first acquisition module, configured to acquire grayscale information of the a*M×b*N first pixels arranged in form of the a*M×b*N matrix; and a third conversion module, configured to convert the grayscale information of the first pixels into transmittance information of the first pixels;

the display unit comprises:

a fourth conversion module, configured to convert transmittance information of N second pixels into grayscale information of the second pixels; and a display module, configured to display the image according to the grayscale information of the second pixels.

* * * * *